United States Patent [19]

Nocek et al.

[11] Patent Number: 4,805,800

[45] Date of Patent: Feb. 21, 1989

[54] DISPENSER FOR PLASTIC BAGS

[75] Inventors: Robert S. Nocek, Stamford, Conn.; Per Bentsen, Suffern, N.Y.; Herbert H. Zivkovic, River Vale, N.J.

[73] Assignee: Minigrip, Inc., Orangeburg, N.Y.

[21] Appl. No.: 904,108

[22] Filed: Sep. 4, 1986

[51] Int. Cl.[4] ..... B65D 85/62

[52] U.S. Cl. ..... 221/63; 206/554

[58] Field of Search ..... 225/106; 221/63, 33, 221/45, 44, 47, 55, 26; 206/494, 449, 554

[56] References Cited

U.S. PATENT DOCUMENTS

| | | | |
|---|---|---|---|
| 4,305,503 | 12/1981 | Membrino | 206/554 |
| 4,416,376 | 11/1983 | Scheffers et al. | 206/554 |
| 4,453,649 | 6/1984 | Origuchi | 221/45 X |
| 4,512,476 | 4/1985 | Herrington, Jr. | 206/554 |
| 4,563,319 | 1/1986 | Ausnit et al. | 264/146 |
| 4,592,840 | 6/1986 | Brooks | 221/63 X |

FOREIGN PATENT DOCUMENTS

| | | | |
|---|---|---|---|
| 2101082 | 1/1983 | United Kingdom | 206/554 |

*Primary Examiner*—F. J. Bartuska

*Attorney, Agent, or Firm*—Hill, Van Santen, Steadman & Simpson

[57] ABSTRACT

A dispenser for plastic bags comprises a container having a dispensing opening through which bags can be withdrawn seriatim from the container. The bags are stacked within the container and each lead bag has a trailing end connected by a line of weakened resistance to the leading end of the trailing bag so that when a lead bag is pulled through the opening, cooperating shoulders on the trailing bag at the ends of reclosable fastener assembly brake the container at the opening and cause the bags to separate at the weakened line. The separated trailing bag is disposed at the opening for subsequent convenient withdrawal. The bags may be stacked by top end-connected pairs within the container. Pressure sensitive adhesive retains the container on a support against displacement when pulling bags from the container. The container may carry a replaceable closure flap for the dispensing opening.

9 Claims, 1 Drawing Sheet

DISPENSER FOR PLASTIC BAGS

BACKGROUND OF THE INVENTION

This invention relates to the dispensing of plastic bags, and is more particularly concerned with a dispenser from which the bags can be conveniently and efficiently withdrawn one at a time.

Plastic bags are commonly supplied for consumer use in packets or bundles from which the separate bags can be separated and used as desired. For example, the bags may be tied in bundles of fifty or one hundred bags, and since such plastic bags are quite slippery, they will spread apart upon being untied or unbanded and are inconvenient to handle.

An example of banding of bundles of bags is found in U.S. Pat. No. 4,563,319 dated Jan. 7, 1986, and assigned to the same Assignee as the instant application. In this patent, there is disclosure of forming the bags in a manner to be joined top end to top end with a perforation along the joint between the bags so that the bags can be pulled apart along the perforation.

In the foresaid patent, the bags are made from material that has separable closure or zipper profile strips extending originally longitudinally along the bag making film material so that when the material is subdivided into end-joined bag sections the zippers are adjacent to the joined top ends of the bags.

By the present invention, it is proposed to package the bags for convenient dispensing in an improved manner compared to prior disclosures such as found in U.S. Pat. No. 4,416,376 dated Nov. 22, 1983, relating merely to packaging of a chain bag arrangement, and Boeckmann application Ser. No. 762,762, filed May 5, 1985, and relating to a bag dispensing arrangement for chain bags. In both of these disclosures the chain bags are connected together at their sides by links aligned with the extruded reclosable fasteners carried by the bags. In order to separate the lead bag from the chain, in Ser. No. 762,762, it is necessary to restrain the trailing bag digitally while the lead bag is pulled free by breaking the chain link connection. It may be noted that application Ser. No. 762,762 is owned by Signode Corporation, which is owned by the same holding company as the Assignee of the present application.

SUMMARY OF THE PRESENT INVENTION

An important object of the present invention is to provide a new and improved dispenser for plastic bags.

Another object of the present invention is to provide a new and improved arrangement of plastic bags and a dispensing container from which a lead bag can be withdrawn and automatically separated from a trailing bag connected thereto.

A further object of the invention is to provide a simple, efficient, low cost plastic bag dispensing device having simple self-retaining means for maintaining the dispenser in position on any selected support for permitting one-handed dispensing of bags from the dispenser.

There is provided by the present invention a dispenser for plastic bags, comprising a container having a dispensing opening through which bags can be withdrawn seriatim from the container, a pack of plastic bags within the container and each bag having a leading end and a trailing end, means connecting the bags at least two-by-two with the trailing end of a lead bag attached to the lead end of a trailing bag, and means for effecting automatic separation of the lead bag from the trailing bag as the lead bag is pulled from the container through the opening.

The invention also provides such a dispenser having new and improved means for retaining the dispenser in position on a support for convenient manual dispensing of bags from the dispenser.

BRIEF DESCRIPTION OF THE DRAWINGS

Other objects, features and advantages of the invention will be readily apparent from the following description of representative embodiments thereof, taken in conjunction with the accompanying drawing, although variations and modifications may be effected without departing from the spirit and scope of the novel concepts embodied in the disclosure, and in which.

DETAILED DESCRIPTION

Figure 1:
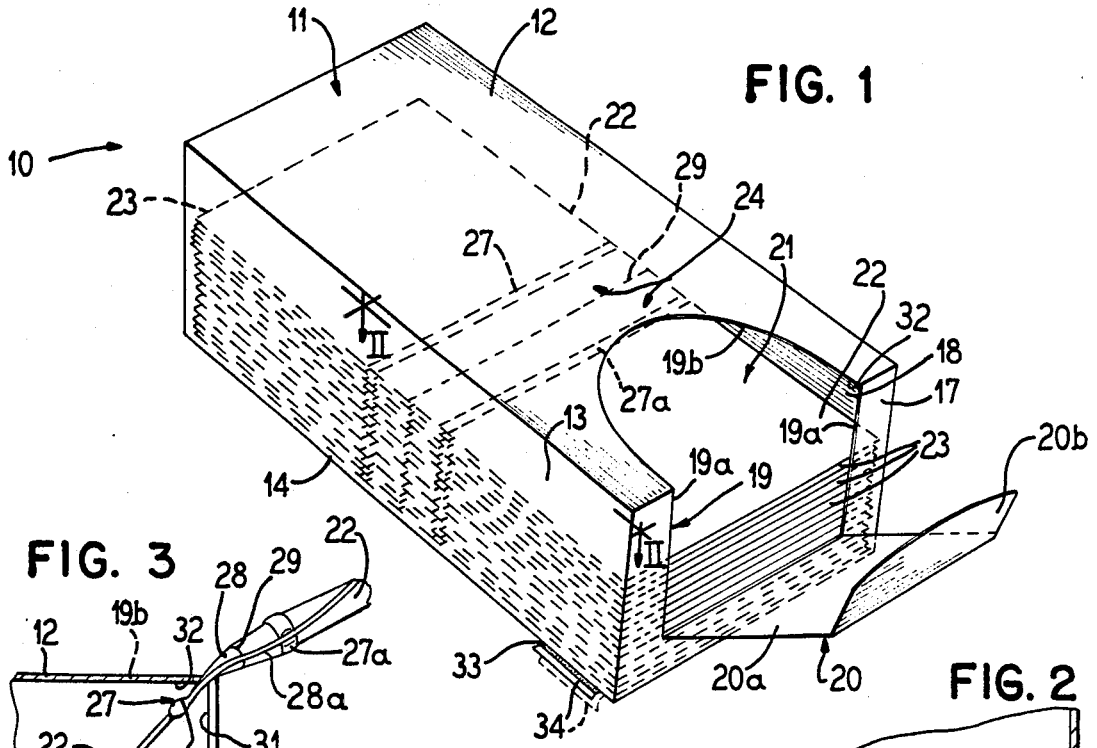
FIG. 1 is a perspective view of a dispenser embodying features of the invention.

A dispenser 10 embodying the invention comprises a container 11 which may be a carton, constructed in any preferred manner, and illustrated schematically without showing the customary overlapping and attachment of parts in setting up such a carton from flat sheet stock. As shown, the container 11 comprises a rectangular, hollow member which is elongated front to rear and has a top wall 12, opposite side walls 13, a bottom wall 14, a rear wall 15, and a front wall 17, and defining within the container a rectangular chamber 18.

In the front wall 17 and the adjacent portion of the top wall 12 is a dispensing opening 19. That portion **19*a* of the opening in the front wall 17 is shorter and narrower than the front wall 17 and leads freely into opening portion 19*b* in the top wall 12 which is of the same width as the portion 19*a* and extends to a length at least as long as the length (or height) of the portion 19*a* in the front wall. Both of the opening portions 19*a* and 19*b* are preferably slightly shorter than the width of the opening 19**.

Desirably, a closure flap 20 is provided having the same dimensions as the opening 19 and provided with a closure portion **20*a* for the opening portion 19*a* and a closure portion 20*b* for closing the opening portion 19*b*. The flap 20 is connected hingedly along the lower edge defining the opening 19. In a sales package the closure portions 20*a* and 20*b* may be initially attached by breakaway connection at its edges to the edges defining the opening 19 as a pilfer deterent. The ultimate consumer can easily break the flap 20 free so that it can be swung open as depicted for dispensing access into the chamber 18. The flap 20** can then be swung back into closing position and may be releasably held in the closed position by frictional engagement of its edges with the edges of the container.

Construction and arrangement of the container 11 is such as to provide for the chamber 18 to be of complementary dimensions to a pack 21 of plastic bags 22.

Preferably, the bags 22 are of the kind disclosed in the aforesaid U.S. Pat. No. 4,563,319, and made from plastic film material and connected in end-to-end relation. In this instance, the bags 22 are assembled in the pack 21 and retained in the pack by the walls of the container 11 rather than being separated in bundles and banded as disclosed in the patent. Each of the bags 22 has opposite ends, one of which is a closed-bottom end 23, and the other a top end 24. Opposite sides 25 of the bag 22 are closed as by means of heat seals.

Along the top end 24 of each bag is an extruded separable fastener assembly, often referred to as a zipper, of any preferred separably interlockable profile structure now common in this art, and which may be of the type disclosed in U.S. Pat. No. 4,563,319. The trailing bag 22 has such a fastener 27 and the lead bag 22 has a like fastener **27*a*. Along the top of each bag 22 and projecting to a desired extent beyond both fasteners 27 and 27*a* are pull flange means comprising pull flanges 28 extending from the fastener 27 and pull flanges 28*a* extending from the fastener 27*a***. These pull flanges enable the bag top in each instance to be opened by grasping the pull flanges and pulling them apart to pull the fastener open.

As packed into the container 11, the bags are connected by pairs head-to-head, with the pull flanges 28, **28*a* separably connected by a line of weakened resistance 29, such as a line of perforations, serrations or thinning extending from side to side of the bag. Thereby, the bags 22 in each pair can be conveniently stacked within the pack 21 in the container and can be separated one from the other by an endwise pull to break the connection 29**.

Figure 3:
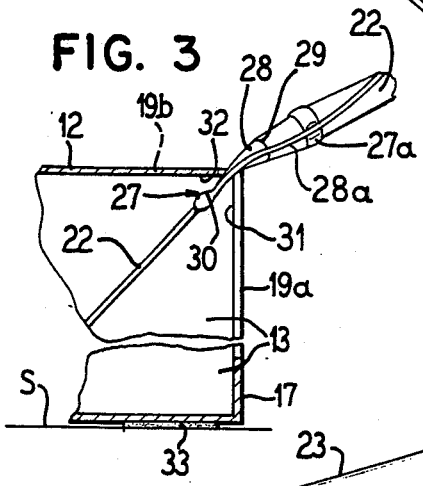
FIG. 3 is a fragmental, sectional elevational view taken substantially along the line III—III in FIG. 2.
Figure 2:
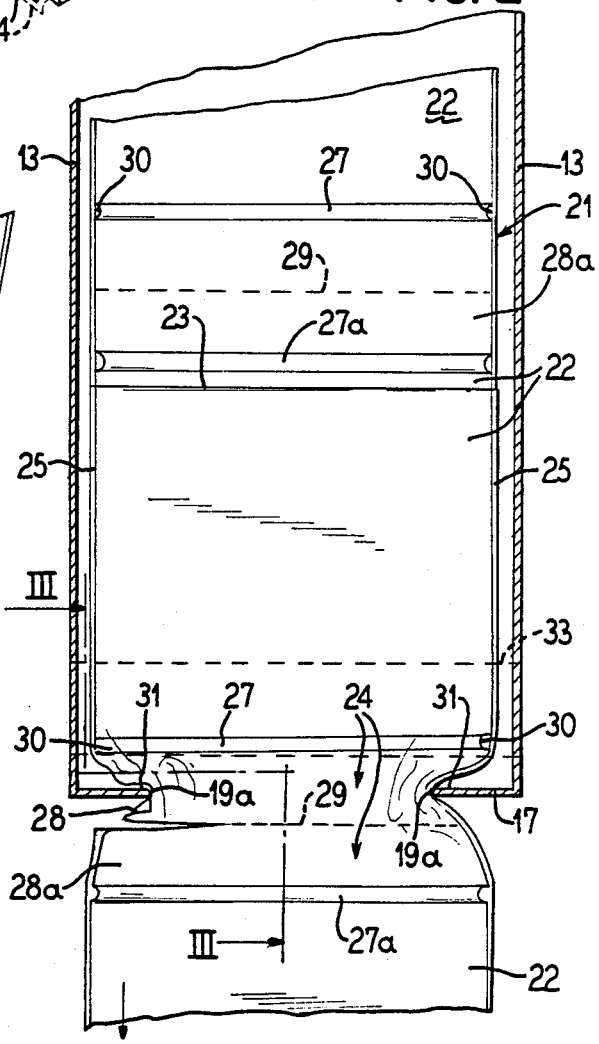
FIG. 2 is a fragmentary top plan, sectional detail view taken substantially in the plane of line II—II in FIG. 1 and showing how a trailing bag is automatically restrained, separated, and retained in the dispensing container when a leading bag is withdrawn.
Figure 4:
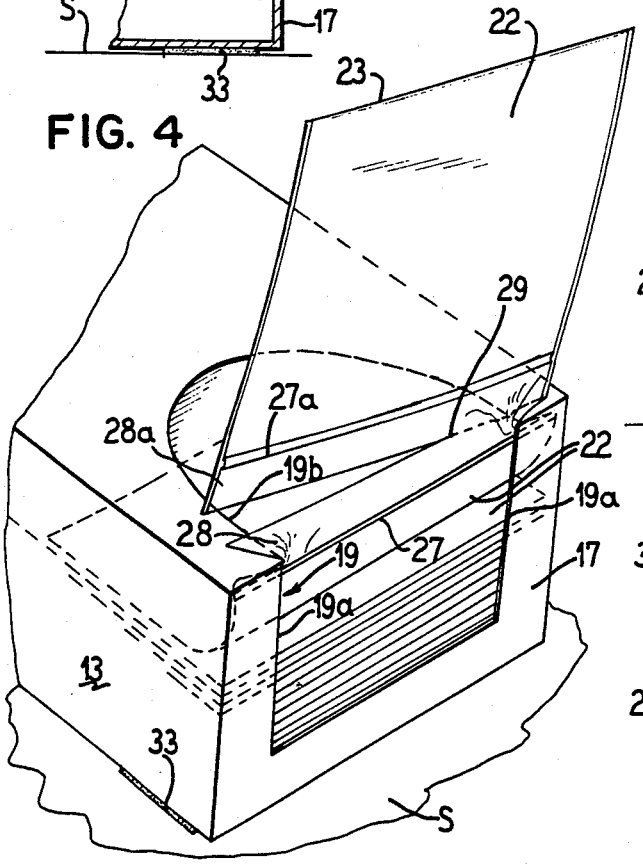
FIG. 4 is a fragmentary front elevational detail view further illustrating how the bags manually dispensed from the dispenser.

Means are provided for effecting automatic separation of the leading bag 22 in each pair from the trailing bag 22 connected thereto as the leading bag is pulled from the container 11 through the opening 19. In a convenient, simple, efficient arrangement, such means for automatic separation comprise cooperating shoulders. Referring to FIGS. 2–4, the trailing bag has shoulders 30 at the opposite ends of the fastener 27. This fastener 27 has sufficient beam strength to provide a resilient stiffening rib tending to hold the shoulders 30 apart. Since the width of the bags 22 and thereby the length of the fastener 27 is greater, preferably by about 25% than the width of the dispenser opening 19, the inwardly facing areas of the front wall 17 along the edges of the opening **19*a* will provide brake means including inwardly facing stop shoulders 31 and the inwardly facing areas of the top wall 12 along the edges of the opening portion 19*b* will provide brake means including inwardly facing stop shoulders 32 (FIG. 3). The shoulders 31 and 32 oppose the bag shoulders 30**.

The shoulders 30 of the trailing bag 22 are drawn toward the stop shoulder 31 or 32 when the lead bag 22 is pulled from the container through the opening 19. Since the rib of the fastener 27 resists bending of the leading end of the trailing bag to pass through the opening 19, when the shoulders 30 are stopped by the carton shoulders 31 or 32, the continuing endwise pulling force on the lead bag causes the line of weakened resistance 29 to rupture or break, and release the lead bag from the trailing bag.

Starting pull applied to the lead end of the lead bag 22 through the opening 19 is facilitated because no appreciable stiffening means interferes with ready curling or bending of the bag upon itself as the leading end of the bag 22 is grasped and pulled out through the opening 19.

As the fastener **27*a* of the lead bag 22 approaches the constriction in the opening 19 defined by the edges 19*a* or 19*b*, this fastener will be caused to bend or otherwise distort or cramp by virtue of the pulling force applied to the lead bag 22 as it is drawn through the opening 19. After the fastener 27*a* has passed out of the opening 19, the beam strength of the fastener 27*a* tends to straighten out this fastener and apply stress through the pull flange 28*a* on the line of weakened resistance connection 29** to accelerate break-away at the weakening.

The pull flange means 28 of the trailing bag 22 will generally be partially pulled out through the opening 19, as seen in FIG. 2, before the entire rupture between the trailing bag and the lead bag can take place. After the automatic separation has been effected by the endwise pull on the lead bag 22, frictional engagement of the pull flange means 28 cramped between the edges **19*a* or 19*b*, as the case may be, tends to hold the now protruding flange means 28 against reverting so that it will provide a convenient handle for digital manipulation for pulling the trailing bag from the container 11 through the opening 19** when desired.

It will be appreciated that by having the opening 19 extended at **19*b* into the top wall 12, not only will initial access to the lead bag 22 be facilitated in each instance, but snaking deformation action of the lead bag fastener 27*a*, as well as subsequently snaking reaction of the separated trailing bag fastener 27 in pullout escape through the relatively narrow opening 19**, will also be facilitated.

To permit one-handed pullout of the bags from the container 11, means are desirably provided for anchoring the container to a support S (FIGS. 3 and 4) such as a counter or the like. Economical, convenient means for this purpose comprises a stripe of pressure sensitive adhesive 33 affixed to the bottom wall 14 of the container 11 preferably extending across the front end portion of the bottom wall 14 below and adjacent to the opening 19. Until the container 11 is to be mounted in dispensing position, the self-adhering stripe 33 is desirably protected by a peel cover strip 34 (FIG. 1). The adhesive 33 serves to anchor the container 11 to the support S with sufficient security to resist separation from the support S due to the drag strain on the front end of the container as the bags are pulled through the opening 19.

It will be understood that variations and modifications may be effected without departing from the spirit and scope of the novel concepts of the present invention.

I claim as my invention:

1. A dispenser for reclosable plastic bags, comprising:

a container having a dispensing opening through which bags can be withdrawn seriatim from said container;

brake means on said container at said dispensing opening;

a pack of plastic bags within said container and each bag having a leading end portion and a trailing end portion;

means connecting said bags at least two-by-two with the trailing end portion of a lead bag attached to the leading end portion of a trailing bag along a line of weakened resistance;

a reclosable fastener assembly extending from side-to-side on the leading end portion of the trailing bag adjacent to said connecting means;

said fastener assembly and said brake means cooperating for effecting automatic separation at said line of weakened resistance of the lead bag from the trailing bag when the lead bag is pulled from the container through said opening and pulls said leading end portion of the trailing bag toward and into engagement of the reclosable fastener on said leading end portion against said brake means; and said pack of bags comprising pairs of bags stacked within the container, said bags having top ends comprising the trailing end portion of the lead bag and the leading end portion of the trailing bag, the top ends of both of the bags in each pair having separable fastener assemblies on the top end of each bag will pull flanges projecting from the fastener assemblies and connected end-to-end at said line of weakened resistance.

2. A dispenser according to claim 1, wherein although said trailing bag reclosable fastener assembly has a beam strength rigidity which resists deformation of the fastener assembly during pulling of the lead bag with force sufficient to effect said separation, said fastener assembly is of sufficient resilient deflectability to permit snaking out of said opening past said brake means in response to direct pull on the leading end pull flange of said trailing bag for pulling the trailing bag past said brake means and out of the container.

3. A dispenser according to claim 1, wherein said container has brake means shoulders at opposite sides of said opening which are spaced apart about 25% less than the width of said pull flanges for crampingly engaging the sides of said pull flanges.

4. A dispenser according to claim 1, wherein said container is of rectangular shape and elongated between a front wall and a rear wall, said front wall having said opening and which is narrower than said pack of bags, said trailing bag having shoulder means on the ends of said trailing bag reclosable fastener assembly, and said brake means cooperating with said shoulder means for effecting stopping of said trailing bag to facilitate said automatic separation.

5. A dispenser according to claim 4, wherein said container has a top wall, and said opening has an extension from said front wall into said top wall.

6. A dispenser according to claim 5, wherein a closure flap on the container is replaceably related to said opening including said extension.

7. A dispenser according to claim 1, said pull flange of said trailing bag being cramped within said opening when pulled through the opening by pull on said lead bag, and said opening having said edges which frictionally retain such pull flange against reversion after separation of said lead bag from said trailing bag so that after the separation such pull flange will serve as a handle which may be grasped for pulling the trailing bag from the container through said opening.

8. A dispenser according to claim 1, wherein opposite ends of the reclosable fastener assembly of the trailing bags have shoulders which are drawn toward said brake means when effecting said separation.

9. A dispenser according to claim 1, wherein said container has a wall having the dispensing opening and connected angularly to another wall, and the dispensing opening has continuously connected parts thereof in said walls with both of said parts of the opening being shorter than the width of the opening.

* * * * *